US007422057B2

(12) United States Patent
Lewis et al.

(10) Patent No.: US 7,422,057 B2
(45) Date of Patent: Sep. 9, 2008

(54) WHIPSTOCK WITH CURVED RAMP

(75) Inventors: Evan G. Lewis, Kingwood, TX (US); Calvin J. Stowe, II, Bellaire, TX (US)

(73) Assignee: Baker Hughes Incorporated, Houston, TX (US)

( * ) Notice: Subject to any disclaimer, the term of this patent is extended or adjusted under 35 U.S.C. 154(b) by 0 days.

(21) Appl. No.: 11/526,412

(22) Filed: Sep. 25, 2006

(65) Prior Publication Data

US 2008/0073073 A1 Mar. 27, 2008

(51) Int. Cl.
*E21B 7/08* (2006.01)

(52) U.S. Cl. ..... 166/117.5; 166/117.6

(58) Field of Classification Search ..... 166/117.5, 166/117.6

See application file for complete search history.

(56) References Cited

U.S. PATENT DOCUMENTS

| | | | | |
|---|---|---|---|---|
| 2,699,920 | A | 1/1955 | Zublin | |
| 3,116,799 | A * | 1/1964 | Lemons | 175/61 |
| 4,420,049 | A | 12/1983 | Holbert | |
| 5,499,680 | A * | 3/1996 | Walter et al. | 166/377 |
| 6,105,675 | A | 8/2000 | Buytaert et al. | |
| 6,209,645 | B1 | 4/2001 | Ohmer | |
| 6,401,821 | B1 | 6/2002 | Kennedy et al. | |
| 6,499,538 | B2 * | 12/2002 | Dewey et al. | 166/297 |
| 2002/0060073 | A1 * | 5/2002 | Dewey et al. | 166/298 |
| 2006/0249310 | A1 * | 11/2006 | Stowe et al. | 175/80 |

* cited by examiner

*Primary Examiner*—William P Neuder
(74) *Attorney, Agent, or Firm*—Steve Rosenblatt

(57) ABSTRACT

The whipstock face below the mounting lug is initially curved with a fairly long radius to protect the whipstock body initially. After moving down the minimally sloping curved face a transition to a greater angle is presented to increase the lateral forces on the window mill and to force the mill laterally to exit the tubular through the window. The transition after the curved portion is preferably to a flat inclined surface to the ramp bottom.

16 Claims, 2 Drawing Sheets

WHIPSTOCK WITH CURVED RAMP

FIELD OF THE INVENTION

The field of this invention is whipstock design for making windows in tubulars downhole for the purpose of extending a lateral bore from a main bore.

BACKGROUND OF THE INVENTION

Whipstocks are devices that have long been in use to deflect a mill system through casing to create an opening known as a window. Whipstocks tend to be very long so that an inclined face on them can gradually nudge a mill system into the casing wall to start the window and to further guide the milling system until it makes an exit though the window. As a result the window shape is long and thin and narrows at the upper and lower ends. The slope on the whipstock guide surface is generally a small angle or series of angles.

Window milling with whipstocks has several unique issues that can affect the performance of the milling equipment. One concern has been when the center of the mill comes even with the casing wall and there is a tendency for the mill to bog down in that position so some designs have featured a steeply inclined surface on the whipstock guide face to engage the mill just as its center is in line with the casing wall. This kick-out surface occurs part way down the guide surface to address one specific problem.

Other approaches to whipstock design concern themselves with avoiding the milling of the whipstock at the onset of milling and configuring the contact angle between the mill and the whipstock guide surface at its upper end to be closer to parallel to decrease contact stress of the mill on the whipstock ramp at the top. The idea was to increase contact stress against the casing so that the casing would be milled rather than the top of the whipstock as the window is initiated.

There have been other approaches to insure getting a long enough window which have mostly been dealt with by making the ramp on the whipstock longer than the needed window length. The thinking here was that the longer ramp was insurance that the window length would not fall below a minimum desired dimension. In these designs, it was anticipated that the window mill will completely leave the ramp well before its lower end and this would insure the window was long enough and that the mill would safely enter the lateral. Even if this concept worked to give a window of a desired length, it created subsequent problems when downhole equipment needed to get through the window. FIG. 1 illustrates the problem. The whipstock face 10 extends downhole below the bottom of the window 12 in wellbore 14. In subsequent trips to get into lateral 16 and complete drilling and completion of it, a pocket trap 18 is created. If the later runs had mills or bits with blades, the blades would hang in the pocket 18 and the equipment would stall. The rig crew would sense this and have to stop rotation and pick up and then resume rotation and hope that on a subsequent attempt they would not direct a blade into the very same pocket trap. On the other hand if the equipment run subsequently had peripheral soft components like rubber seals or packer seals, the edge 20 of casing 22 acted as a razor sharp surface that could easily shred the softer components and render them unserviceable.

FIG. 2 shows another problem with whipstocks in the past. Here the mill fails to make an exit at the ramp end and simply continues to mill the whipstock base 24 and an anchor 26 below as indicated by the dashed line 28.

Over the years different ideas have been tried in whipstock designs but these problems have persisted. Several designs have tried gradual slopes and arcuate guide surfaces over the length of the whipstock all in the name of better mill guidance but none of these designs have eliminated the conditions depicted in FIGS. 1 and 2. Some examples of such designs are U.S. Pat. Nos.: 4,420,049; 3,116,799; 6,401,821; 2,699,920; 6,105,675; and 6,209,645. The last patent actually puts a radial surface 300 for the mill to catch on to hopefully define the lower end of the window.

One attempt to solve the above described problems has been to include an end surface on the guide face of the whipstock that is a sharper angle than the long gradual guide surface that is normally in the range of about 3 degrees. In soft formations the increase in angle at the ramp bottom puts a greater lateral load on the mill to help keep it against the whipstock surface as opposed to kicking out too early. In the hard formations the steeper end face directs the mill away from the whipstock to try to avoid having it continue down misdirecting the lateral and potentially damaging the whipstock or underlying anchor. With this approach it was hoped to eliminate the problems described above and left unresolved by the prior art but such was not the case.

The present invention addresses the needs at the start and conclusion of the window milling process. It features a rather large radius surface initially below the lug holding the window mill for run in. After some progress milling the window the ramp transitions to a greater angle to increase the lateral force on the mill and ensure its proper exit within the length of the ramp.

These and other features of the present invention will be more readily appreciated by those skilled in the art from a review of the description of the preferred embodiment and the claims that appear below.

SUMMARY OF THE INVENTION

The whipstock face below the mounting lug is initially curved with a fairly long radius to protect the whipstock body initially. After moving down the minimally sloping curved face a transition to a greater angle is presented to increase the lateral forces on the window mill and to force the mill laterally to exit the tubular through the window. The transition after the curved portion is preferably to a flat inclined surface to the ramp bottom.

DETAILED DESCRIPTION OF THE PREFERRED EMBODIMENT

Figure 1:
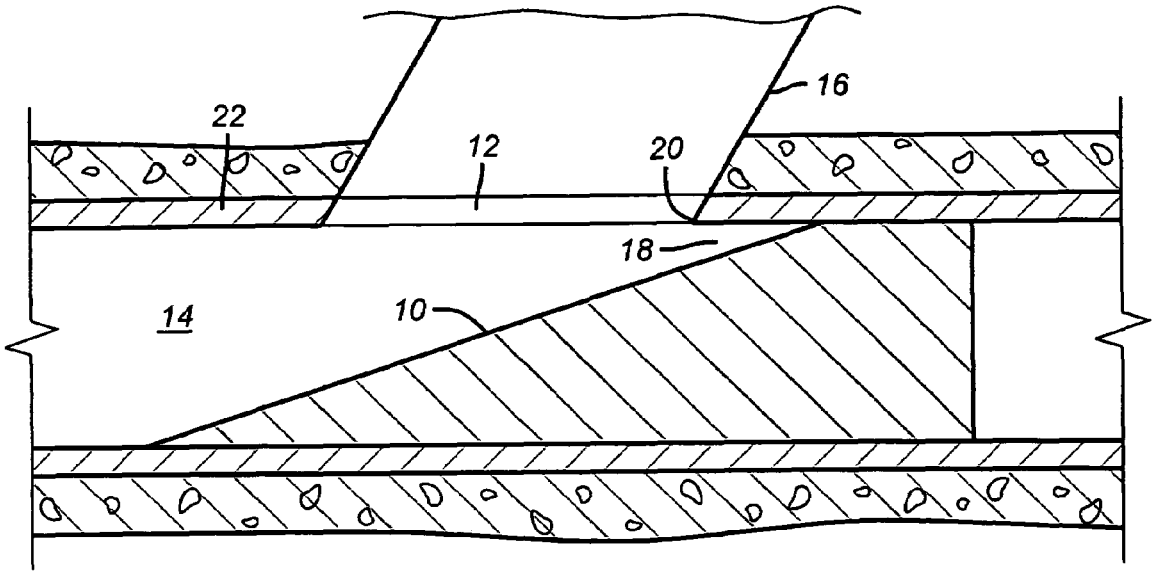
(PRIOR ART) FIG. 1
FIG. 1 is section view of a prior art design with the ramp longer than the intended window and the formation of a pocket as a result.
Figure 2:
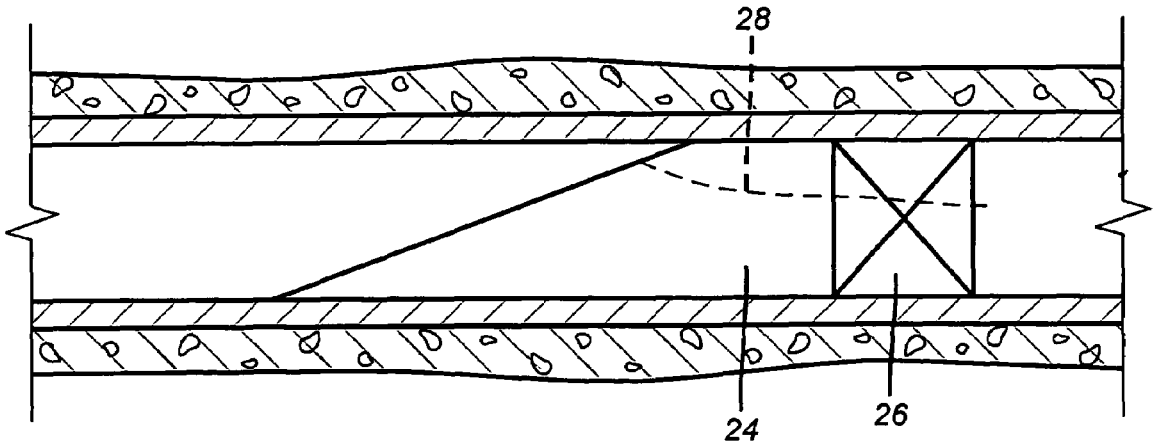
(PRIOR ART) FIG. 2
FIG. 2 is a section view of a prior art design that shows milling the whipstock and the anchor instead of licking out when needed to make the window bottom.
Figure 3:
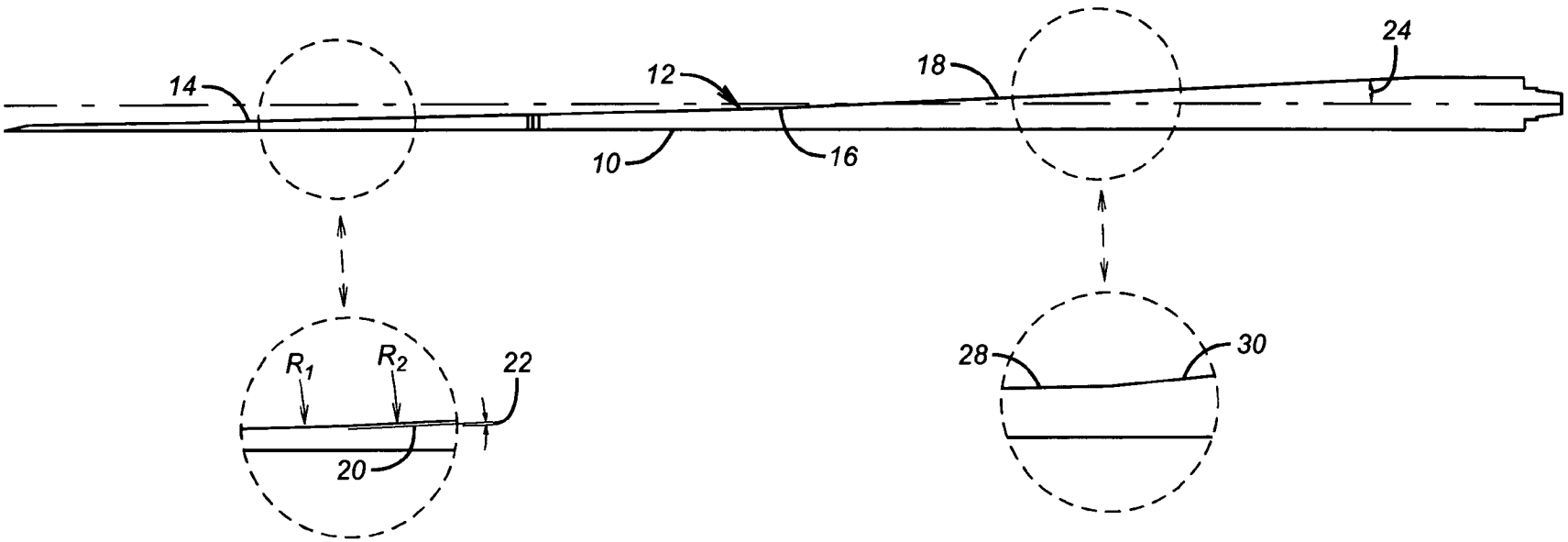
FIG. 3 is an illustration of the whipstock ramp having a curved upper face and a lower ramp section that is preferably flat and inclined further featuring enlarged views that illustrate the curved portion having more than one radius, an inclined tangent line of more than 1 degree, a flat portion incline of about 3 degrees and the flat portion made up of flat sections with different slopes.

FIG. 3 shows a whipstock 10 with an overall ramp 12 that has an arcuate upper section 14, a transition point 16 and a lower ramped section 18. The curved section preferably extends for 33% or less of the total length of ramp 12. The ramp 12, for purposes of the percentage allocation, begins below a lug (not shown) that holds a window mill (not shown) to the whipstock 10 for running into the wellbore. While the radius of the curved section can vary with the size of the whipstock 10, the initial portions of the curved section are at a fairly minimal slope so as to exert a fairly moderate lateral force on the window mill as the milling starts. However, unlike totally curved whipstocks of the past, the present invention recognizes that the lateral force must be increased to get the window mill through the window and to properly kick off the lateral. For that reason a transition occurs at 16 to what is preferably a flat surface at a greater incline than the terminal incline at the lower end of the curved section 14.

While the curved section 14 can be a single radius, it can also be a composite surface of radii such as $R_1$ and $R_2$ that vary to progressively smaller radii in the downhole direction. A tangent line 20 is shown at an incline of about 1 degree as angle 22. The initial inclination of a tangent line to the curved section near its top is preferably between 0.5 and 1 degrees. The flat section can have an inclination of about 3 degrees or more as shown at angle 24 depending on the end inclination of the curved section. In any event, the flat section will represent an increase over the terminal inclination of the curved section 14.

Those skilled in the art will appreciate that with the small initial angles of the upper reaches of the curved section 14 the stress in the connection between the window mill and the next mill above it is also minimized as the bending of that component is reduced until some part of the window has been made. On the other hand, at some point of making the window the lateral forces on the window mill need to increase to assure a proper exit for the new lateral and the segment 18 helps to do that. There is less material that needs to be removed to produce the whipstock using the curved upper section 14.

While the lower section 18 is described as flat those skilled in the art will appreciate that it can be a single or multiple slopes such as shown by adjacent flat sections 28 and 30 that are at different slopes.

The above description is illustrative of the preferred embodiment and many modifications may be made by those skilled in the art without departing from the invention whose scope is to be determined from the literal and equivalent scope of the claims below:

We claim:

1. A whipstock for downhole use, comprising:

a body having a ramp with a lower and an upper end where a portion of said ramp extending axially from adjacent said upper end is curved and a portion of the ramp extending from said curved portion to adjacent said lower end is at least one flat disposed on at least one slope.

2. The whipstock of claim 1, wherein:

said curved portion extends up to 33% of the length of said ramp.

3. The whipstock of claim 2, wherein:

said curved portion is at a constant radius.

4. The whipstock of claim 2, wherein:

said curved portion has more than one radius.

5. The whipstock of claim 1, wherein:

said at least one flat comprises a single flat surface to said lower end of said ramp.

6. The whipstock of claim 1, wherein:

said at least one flat comprises a plurality of flat surfaces to said lower end of said ramp.

7. The whipstock of claim 6, wherein:

said flat surfaces have progressively greater slopes in a direction toward said lower end of said ramp.

8. The whipstock of claim 5, wherein:

said single flat portion has a greater slope than said curved portion at the location where said portions meet.

9. The whipstock of claim 1, wherein:

a tangent line to said curved portion near the upper end is inclined up to 1 degree.

10. The whipstock of claim 9, wherein:

the slope along some portion of said flat portion exceeds 3 degrees.

11. The whipstock of claim 6, wherein:

the slope along some portion of said flat portion exceeds 3 degrees.

12. The whipstock of claim 1, wherein:

said body comprises a mounting lug for a window mill disposed above said upper end of said ramp.

13. The whipstock of claim 3, wherein:

said at least one flat comprises a single flat surface to said lower end of said ramp.

14. The whipstock of claim 13, wherein:

said single flat portion has a greater slope than said curved portion at the location where said portions meet.

15. The whipstock of claim 14, wherein:

a tangent line to said curved portion near the upper end is inclined up to 1 degree.

16. The whipstock of claim 15, wherein:

the slope along said flat portion exceeds 3 degrees.

* * * * *